US005957191A

United States Patent [19]

Okada et al.

[11] Patent Number: 5,957,191

[45] Date of Patent: Sep. 28, 1999

[54] CASTING METHOD AND APPARATUS USING A RESIN CORE

[75] Inventors: Masamichi Okada, Toyota; Tatsuhiko Sawamura, Tokyo; Norio Hayashi, Yokkaichi; Takayuki Ito, Hiratsuka, all of Japan

[73] Assignees: Toyota Jidosha Kabushiki Kaisha, Toyota; Aisin Seiki Kabushiki Kaisha, Kariya, both of Japan

[21] Appl. No.: 08/707,455

[22] Filed: Sep. 4, 1996

[30] Foreign Application Priority Data

Sep. 5, 1995 [JP] Japan ..... 7-228392

[51] Int. Cl.[6] ..... B22C 9/10

[52] U.S. Cl. ..... 164/132; 164/113; 164/138; 164/319; 164/320; 164/369; 249/144; 249/111; 249/175

[58] Field of Search ..... 164/132, 113, 164/138, 319, 320, 369; 249/144, 111, 134, 175

[56] References Cited

U.S. PATENT DOCUMENTS

| | | | |
|---|---|---|---|
| 4,093,175 | 6/1978 | Putzer et al. | 249/153 |
| 4,927,688 | 5/1990 | Hass et al. | 164/132 |
| 5,285,840 | 2/1994 | Hayashi et al. | 164/320 |
| 5,566,742 | 10/1996 | Memoto | 164/132 |

FOREIGN PATENT DOCUMENTS

| | | |
|---|---|---|
| 6-91345 | 4/1994 | Japan . |
| 6-99247 | 4/1994 | Japan . |
| 6-99436 | 4/1994 | Japan . |
| 6-122037 | 5/1994 | Japan . |
| 6-126376 | 5/1994 | Japan . |
| 6-198388 | 7/1994 | Japan . |
| 6-292941 | 10/1994 | Japan . |
| 6-328195 | 11/1994 | Japan . |
| 7-1079 | 1/1995 | Japan . |
| 7-1080 | 1/1995 | Japan . |
| 7-195144 | 8/1995 | Japan . |
| 7-195145 | 8/1995 | Japan . |
| 7-195147 | 8/1995 | Japan . |
| 8-90158 | 4/1996 | Japan . |

*Primary Examiner*—Patrick Ryan
*Assistant Examiner*—I. - H. Lin
*Attorney, Agent, or Firm*—Pillsbury Madison & Sutro LLP

[57] ABSTRACT

A casting method and apparatus using a resin core wherein a portion of a wall of the resin core that receives a greater heat and/or load than other portions of the wall of the resin core, is increased in thickness. As a result, even if the resin core receives more heat and/or load in places, a local deformation or breakage of the resin core is effectively prevented.

10 Claims, 3 Drawing Sheets

$t_1$ : START OF SUPPLY OF MOLTEN METAL $t_2$ : FINISH OF SUPPLY OF MOLTEN METAL $t_3$ : COMPLETION OF SOLIDIFICATION OF MOLTEN METAL $t_4$ : OPENING OF MOLD

CASTING METHOD AND APPARATUS USING A RESIN CORE

BACKGROUND OF THE INVENTION

1. Field of the Invention

The present invention relates to a casting method and apparatus in which a resin core is used.

2. Description of Related Art

In the die casting of a metal product, a core is used for forming an undercut portion and a vacant interior of the product. In a gravity die casting process, a sand core is usually used because the sand core can be easily removed from the product after casting because it collapses easily.

Recently, a resin core was proposed, for example, in Japanese Patent Publication No. HEI 6-91345, with a core made from thermoplastic resin that was removed from a product by heating the core and thereby melting the resin core. In order to prevent some of the melted resin from remaining in the product, a resin core removal method is proposed in Japanese Patent Application No. HEI 7-164299 where the resin core, having a substantially uniform wall thickness, is taken out of the cast metal product by drawing before it is melted so that the drawing force can be transmitted in the resin core and the entire portion of the resin core can be taken out of the cast metal product.

The above-described resin core, with a wall having a substantially uniform thickness, still has the following problems.

In a case where a cast metal product has a relatively thick portion (large thermal capacity portion), a portion of the resin core contacting the relatively thick portion of the cast metal product tends to be melted by receiving residual heat from the cast metal product. If this melting occurs, the accuracy of the shape and the dimensions of the portion of the cast metal product that contacts the melted portion of the core will be compromised.

A shrinkage recess or cavity may also be caused in a surface of a portion of the cast metal product that contacts the resin core when the portion is solidified after the other portions of the metal product.

Furthermore, the resin core may be destroyed in places if a load acting on a portion of the resin core from the molten metal, which flows into a molding cavity at a high speed and at a high pressure, exceeds the strength of the portion of the resin core.

The resin core may also be destroyed in places if a load acting on a portion of the resin core from a pressure pin exceeds the strength of the portion of the resin core.

SUMMARY OF THE INVENTION

An object of the present invention is to provide a casting method and apparatus using a resin core which is unlikely to be destroyed even if it receives a large heat and/or load.

BRIEF DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENTS

Figure 1:
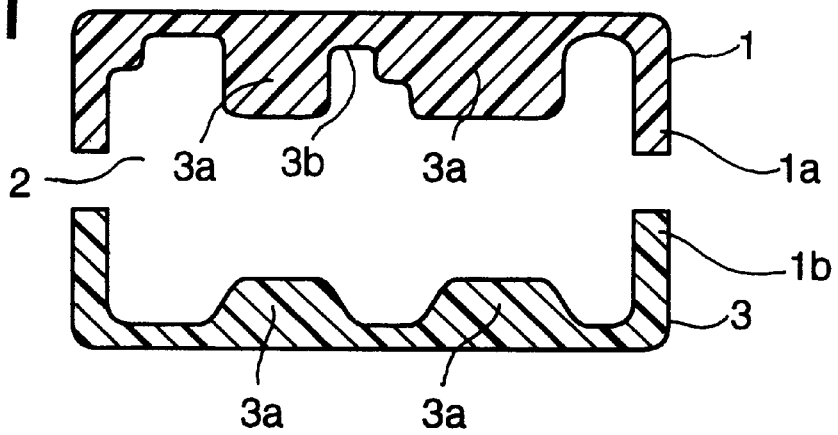
FIG. 1 is a cross-sectional view of a resin core during manufacturing, used in a casting method and apparatus according to a first embodiment of the present invention.
Figure 2:
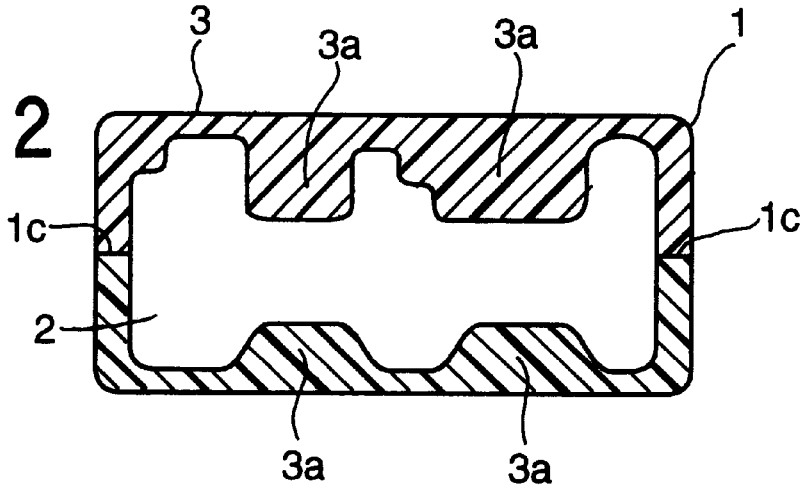
FIG. 2 is a cross-sectional view of the resin core of FIG. 1 after manufacturing.
Figure 3:
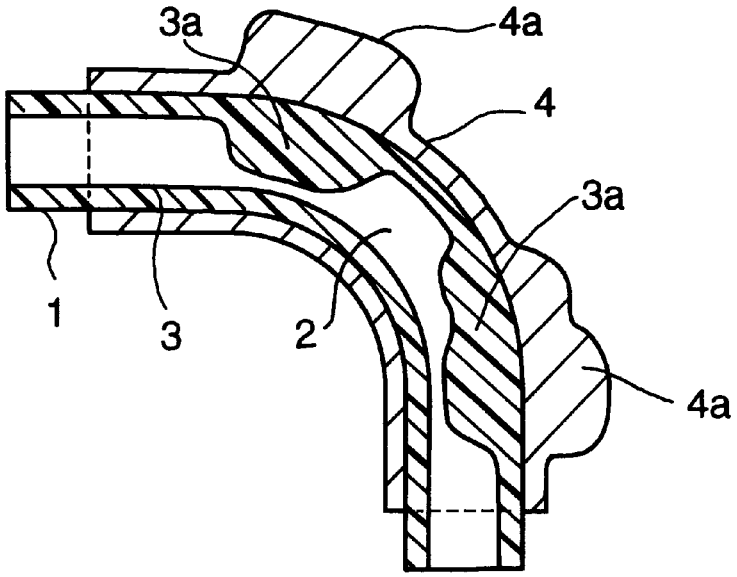
FIG. 3 is a cross-sectional view of a resin core and a cast metal product showing a casting method and apparatus according to a second embodiment of the present invention.
Figure 4:
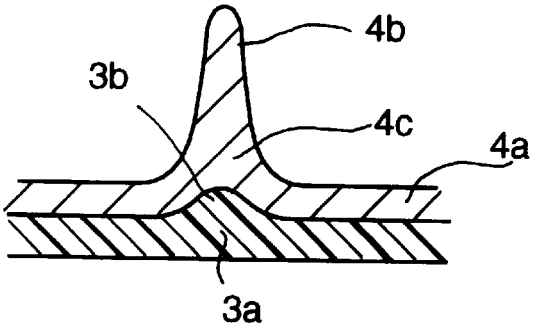
FIG. 4 is a cross-sectional view of a resin core and a cast metal product showing a casting method and apparatus according to a third embodiment of the present invention.
Figure 5:
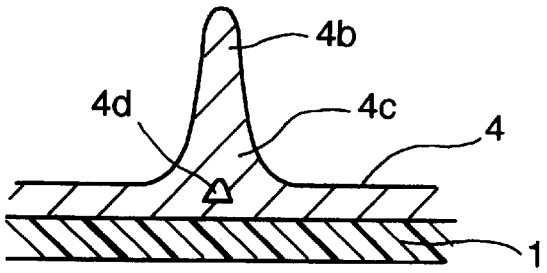
FIG. 5 is a cross-sectional view of a resin core and a cast metal product showing that an increased thickness portion is not formed in the resin core and that a shrinkage defect is generated in the cast metal product.
Figure 6:
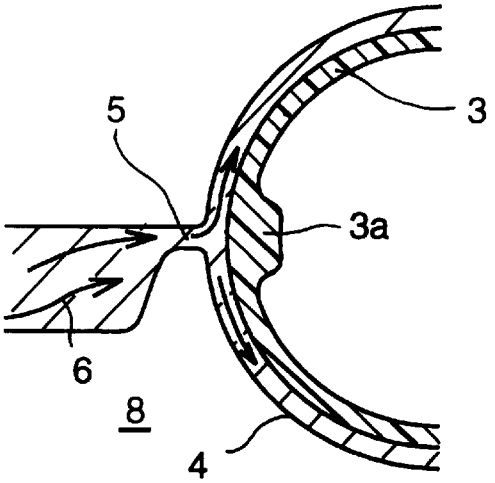
FIG. 6 is a cross-sectional view of a resin core and a molten metal injection gate showing a casting method and apparatus according to a fourth embodiment of the present invention.
Figure 7:
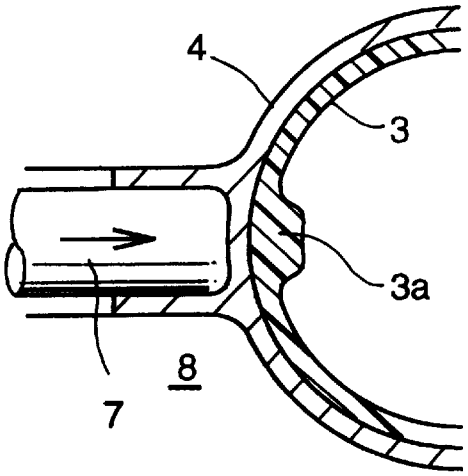
FIG. 7 is a cross-sectional view of a resin core and a pressure pin showing a casting method and apparatus according to a fifth embodiment of the present invention.
Figure 8:
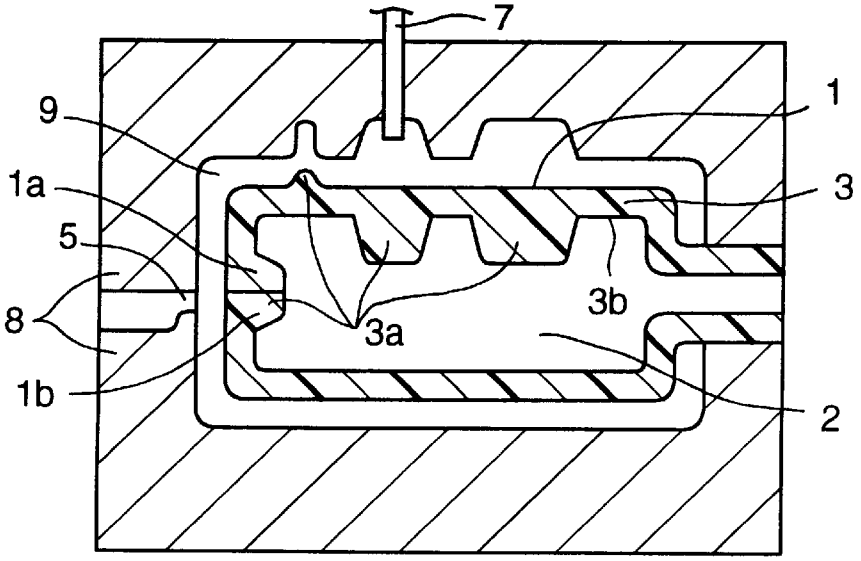
FIG. 8 is a cross-sectional view of a casting apparatus showing a casting method applicable to virtually any embodiment of the present invention.
Figure 9:
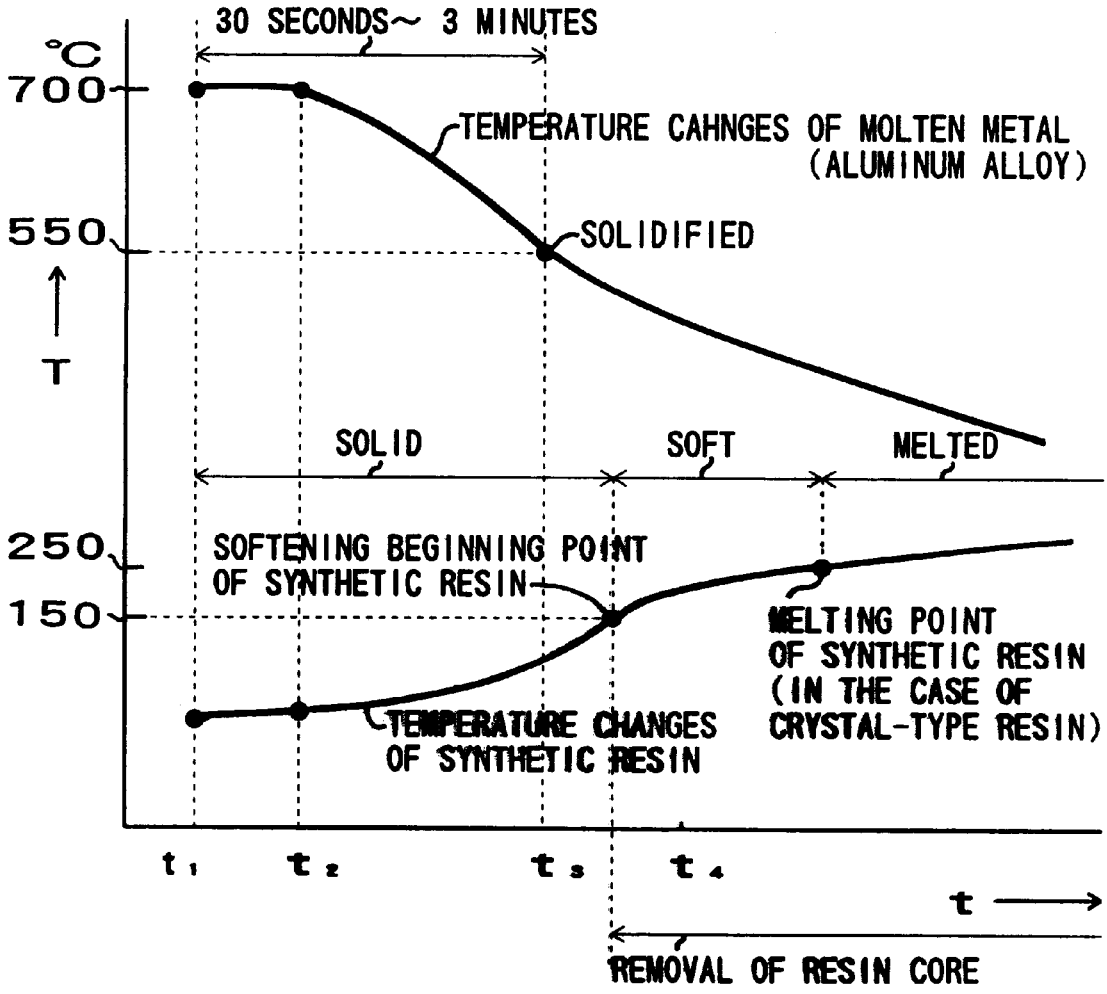
FIG. 9 is a graph showing the relationship between the temperatures of the resin core and the cast metal product with the elapsed time applicable to any embodiment of the present invention.

FIGS. 1 and 2 illustrate a first embodiment of the present invention; FIG. 3 illustrates a second embodiment of the present invention; FIGS. 4 and 5 illustrate a third embodiment of the present invention; FIG. 6 illustrates a fourth embodiment of the present invention; and FIG. 7 illustrates a fifth embodiment of the present invention. FIGS. 8 and 9 are applicable to virtually any embodiment of the present invention. Portions common or similar to all of the embodiments of the present invention are denoted with the same reference numerals throughout all of the embodiments of the present invention.

First, portions common or similar to all of the embodiments of the present invention will be explained with reference to, for example, FIGS. 1, 2, 8 and 9.

FIG. 8 shows an apparatus for producing a cast metal product including a mold 8 and a core 1 set within the mold 8. The mold 8 and the core 1 define a molding cavity 9 for molding a cast metal product 4. The core 1 is made from thermoplastic resin. The core 1 includes a wall 3 defining a vacant interior 2 within the wall 3 so that the resin core 1 can be deformed utilizing the vacant interior when the resin core 1 is removed from the cast metal product 4 after molding. The wall 3 of the core 1 includes at least one increased thickness portion 3*a* which is increased in thickness compared with portions 3*b* of the wall 3. The increased thickness portion 3*a* of the wall 3 is formed in a portion where the wall 3 receives greater heat and/or load greater than other portions 3*b* of the wall 3 of the resin core 1.

The resin core 1 includes divided parts 1*a* and 1*b* which are formed using injection molding, and adhered to each other to complete the core 1. Each of the parts 1*a* and 1*b* can be formed to a desired wall thickness at a desired portion of the core.

As shown in FIG. 8, the resin core 1 is set within the mold 8 to thereby form the molding cavity 9. The mold 8 may be provided with a pressure pin 7. The core 1 includes the wall 3 defining a vacant interior therein, and the wall 3 of the core 1 includes at least one increased thickness portion 3*a* compared with portions 3*b* of the wall. Then, molten metal 6, for example molten aluminum alloy, is supplied into the molding cavity 9 at a high pressure (for example, at a pressure above 80 MPa) or at a low pressure. When the molten metal solidifies, a cast metal product 4 is produced.

The core 1 forms an undercut portion or a hollow portion in the cast metal product 4. After the supplied metal has solidified, the mold 8 is opened and the cast metal product 4 is taken out from the mold 8. Then, the resin core 1 is removed from the cast metal product 4 by deforming the resin core 1 through a hole formed in the cast metal product 4. The removed core is recycled as a material for a new resin core.

When removing the resin core 1 from the cast metal product, the resin core 1 is softened by the residual heat from the cast metal product 4 or by reheating the resin core and the metal product, but not enough to melt the cast metal product 4. Because the resin core 1 is not yet completely melted, the resin core 1 can transmit the drawing load and the entire portion of the resin core 1 can be drawn out of the cast metal product 4. Therefore, unlike a completely melted resin core 1, a portion of the resin does not remain in the cast metal product.

FIG. 9 illustrates the relationship between a temperature change of the resin core and a temperature change of the molten metal in the case where the molten metal is aluminum alloy. More particularly, when the molten aluminum alloy is supplied into the molding cavity, the temperature of the molten aluminum alloy during the time period from t1 to t2 is about 700° C., and the temperature of the molten metal aluminum alloy decreases to about 550° C. within 10 seconds and 3 minutes. The time varies according to a volume of the cast metal product 4.

On the other hand, the temperature of the resin core 1 rises as it receives the heat from the molten metal. As shown, the temperature of the resin core 1 has not yet risen to the beginning of the softening of the resin (about 150° C.) at a solidification completing time t3 of the molten metal. Therefore, the molten metal completes its solidification while the resin core 1 is in a solid state. As a result, the resin core 1 is unlikely to cause a deformation even if it receives a high pressure of high load from the molten metal, so that a cast metal product 4 having a better dimensional accuracy can be obtained.

The resin core 1 then rises in temperature and begins to soften at the softening beginning point (about 150° C.).

After the solidification completing time t3 the mold 8 is opened and preferably at a time after the softening beginning time of the resin core. Removing the resin core 1 from the cast metal product 4 is performed after the mold opening time t4 and before the resin core 1 is completely melted, that is, while the resin core 1 is in a softened state (in a case of a crystal-type resin, before the core 1 is melted). In this regard, the softened state means that an elastic rate of the resin is in the approximate range of $10^{-2}$–$10^{-5}$ GPa. Because the resin core 1 is softened but not melted, the resin core 1 itself can transmit the drawing force (tension), so that the entire resin core 1 can be drawn without causing a breakage within the cast metal product and without remaining within the cast metal product. The thermoplastic resin showing the above-described softening and melting characteristics best includes crystal resins such as polypropylene and non-crystal-plastics, for example, polycarbonate, polystyrene (high impact polystyrene), and ABS resin, though the non-crystal-plastics do not have a melting point.

The wall 3 of the resin core 1 includes the increased thickness portion 3*a* at a portion where the wall 3 receives a greater load and/or heat than other portions 3*b* of the wall 3. Therefore, the resin core 1 is unlikely to cause a deformation and breakage at the increased thickness portion 3*a* when the core 1 receives a load and heat from the molten metal supplied into the molding cavity. As a result, deformation of the cast metal product 4 will also be prevented at the portion of the product corresponding to the increased thickness portion 3*a* of the core 1. Furthermore, since the wall 3 of the core 1 is increased in thickness only locally, costs for the resin core 1 can be suppressed.

Portions unique to each embodiment will be now explained.

In the first embodiment of the present invention, as illustrated in FIGS. 1 and 2, the resin core 1 includes two parts 1*a* and 1*b* which define a vacant interior 2 therein when the two parts are joined to each other. The wall 3 of the core 1 includes a plurality of increased thickness portions 3*a* which can be formed due to the two part structure of the core.

In the second embodiment of the present invention, as illustrated in FIG. 3, the cast metal product 4 includes an increased thickness portion 4*a*. A portion of the wall 3 of the resin core 1 contacts the increased thickness portion 4*a* of the cast metal product 4. The increased thickness portion 3*a* of the wall 3 of the resin core 1 is formed in the portion of the wall 3 that contacts the increased thickness portion 4*a* of the cast metal product 4.

Though the increased thickness portion 4*a* of the cast metal product 4 gives a greater heat to the resin core 1 than other thinner portions of the cast metal product, the core 1 also is thickened to have a large heat resistance at the portion corresponding to the increased thickness portion 4*a* so that the core 1 can endure the heat and load.

As a result, the increased thickness portion 3*a* of the wall 3 of the core 1 is unlikely to be softened before the molten metal has solidified and therefore, a better dimensional accuracy of the cast metal product 4 can be obtained.

In the third embodiment of the present invention, as illustrated in FIGS. 4 and 5, the cast metal product 4 includes a rib 4*b* having a root 4*c*. A portion of the wall 3 of the resin core 1 contacts the root 4*c* of the rib 4*b* of the cast metal product 4. The increased thickness portion 3*a* is formed in the portion of the wall 3 that contacts the root 4*c* so as to protrude into the root 4*c* of the rib 4*b*.

As shown in FIG. 5, the root 4*c* of the rib 4*b* has a greater thickness or volume than other portions of the cast metal product 4 so that it solidifies later than other portions of the cast metal product 4 and a shrinkage hole 4*d* is likely to be caused. In FIG. 4, however, the protruding portion 3*b* contacts and pushes the root 4*c* of the rib 4*b* of the cast metal product 4, a shrinkage hole 4*d* is prevented.

In the fourth embodiment of the present invention, as illustrated in FIG. 6, the mold 8 includes a molten metal injection gate 5 through which the molten metal 6 is supplied into a molding cavity 9. The increased thickness portion 3*a* of the wall 3 of the resin core 1 is formed in the portion of the wall 3 of the resin core 1 opposing the molten metal injection gate 5.

In die casting the molten metal 6 is usually supplied into the molding cavity at a high speed, as high as about 40 m/sec, and at a high pressure, as high as about 80 MPa, the portion of the core 1 opposing the injection gate 5 is likely to receive a large load and heat from the supplied molten metal and therefore to break. However, since the portion of the core 1 opposing the injection gate 5 is increased in thickness, that portion of the core 1 can endure the load and heat and thereby prevent breakage of the resin core 1.

In the fifth embodiment of the present invention, as illustrated in FIG. 7, the casting apparatus includes a pressure pin 7 which penetrates the casting mold 8 so that the pressure pin 7 can press a portion of the molten metal having a great volume (a portion likely corresponding to the increased thickness portion of the cast metal product) before the metal solidifies. A portion of the wall 3 of the resin core 1 opposes the pressure pin 7. The increased thickness portion 3*a* of the wall 3 is formed to oppose the pressure pin 7.

When the pressure pin 7 presses the molten metal, the portion of the wall 3 that opposes the pressure pin 7 also receives the pressing force of the pressure pin 7. However, since the portion of the core 1 is increased in thickness 3*a,* it can endure the pressing force of the pressure pin 7 and prevent damage or deformation of the resin core 1.

According to the present invention, the following advantages can be obtained.

First, the resin core 1 can effectively endure the heat and/or load since the wall 3 of the resin core 1 is increased in thickness in places.

Second, the wall 3 of the resin core 1 is increased in thickness only in certain places and therefore, the increase in manufacturing cost of the resin core 1 is minimized.

Although the present invention has been described with reference to specific exemplary embodiments, it will be appreciated by those skilled in the art that various modifications and alterations can be made to the particular embodiments shown, without materially departing from the novel teachings and advantages of the present invention. Accordingly, it is to be understood that all such modifications and alterations are included within the spirit and scope of the present invention as defined by the following claims.

What is claimed is:

1. An apparatus for producing a cast metal product comprising:

a mold having an inner surface; and a thermoplastic resin core including a wall having an inner wall surface and an outer wall surface, said inner wall surface defining a vacant interior therein, said wall of said core including at least one increased thickness portion which has a greater thickness, defined as a distance between said inner wall surface and said outer wall surface, than portions of said wall surrounding said increased thickness portion, wherein said core is set mostly within said mold so as to provide a molding cavity between said inner surface of said mold and said outer wall surface of said wall, and said increased thickness portion of said wall of said core is provided at a portion of said wall where said wall receives greater heat or load than other portions of said wall.

2. An apparatus according to claim 1, wherein said molding cavity has an increased thickness portion having a greater thickness, defined as a distance between said inner surface of said mold and said outer wall surface of said wall of said core, than portions of said molding cavity surrounding said increased thickness portion of said molding cavity, and said increased thickness portion of said wall of said core is formed to correspond to said increased thickness portion of said molding cavity.

3. An apparatus according to claim 1, wherein said molding cavity is shaped to form said cast metal product to include a rib having a root, said increased thickness portion of said wall of said core is formed towards said molding cavity at a portion of said wall of said core to correspond with said root so as to protrude into said root of said rib.

4. An apparatus according to claim 1, wherein said mold includes a molten metal injection gate, and said increased thickness portion of said wall of said core is formed towards said vacant interior of said core at a portion of said wall of said core that opposes said molten metal injection gate.

5. An apparatus according to claim 1, wherein said casting apparatus includes a pressure pin, and said increased thickness portion of said wall of said core is formed towards said vacant interior of said core at a portion of said wall of said core that opposes said pressure pin.

6. A method for producing a cast metal product comprising the following steps of:

setting a thermoplastic resin core with a wall having an inner wall surface and outer wall surface within a mold having an inner surface to thereby form a molding cavity between said inner surface of said mold and said outer wall surface of said core, said inner wall surface of said wall of said core defining a vacant interior therein, said wall of said core including at least one increased thickness portion which has a greater thickness, defined as a distance between said inner wall surface and said outer wall surface, than portions of said wall surrounding said increased thickness portion;

supplying molten metal into said molding cavity, said molten metal solidifying to form said cast metal product;

opening said mold and removing said cast metal product including said core therein; and removing said core from said cast metal product before said core is completely melted.

7. A method according to claim 6, wherein said molding cavity has an increased thickness portion having a greater thickness, defined as a distance between said inner surface of said mold and said outer wall surface of said wall of said core, than portions of said molding cavity surrounding said increased thickness portion of said molding cavity, and said increased thickness portion of said wall is formed to correspond to said increased thickness portion of said molding cavity.

8. A method according to claim 6, wherein said molding cavity is shaped to form said cast metal product to include a rib having a root, said increased thickness portion of said wall of said core is formed towards said molding cavity at a portion of said wall of said core to correspond with said root so as to protrude into said root of said rib.

9. A method according to claim 6, wherein said mold includes a molten metal injection gate, and said increased thickness portion of said wall of said core is formed towards said vacant interior of said core at a portion of said wall of said core that opposes said molten metal injection gate.

10. A method according to claim 6, wherein said casting apparatus includes a pressure pin, and said increased thickness portion of said wall of said core is formed towards said vacant interior of said core at a portion of said wall of said core that opposes said pressure pin.

* * * * *